US005670938A

United States Patent [19]

Ohtani et al.

[11] Patent Number: 5,670,938

[45] Date of Patent: Sep. 23, 1997

[54] FIRE ALARM DEVICE

[75] Inventors: Shigeru Ohtani, Kanagawa; Hiromitsu Ishii; Takashi Ono, both of Chiba, all of Japan

[73] Assignee: Hochiki Kabushiki Kaisha, Tokyo, Japan

[21] Appl. No.: 441,808

[22] Filed: May 16, 1995

Related U.S. Application Data

[63] Continuation-in-part of Ser. No. 816,186, Jan. 2, 1992, abandoned.

[30] Foreign Application Priority Data

Jan. 18, 1991 [JP] Japan ..... 3-4650

[51] Int. Cl.[6] ..... G08B 29/00

[52] U.S. Cl. ..... 340/506; 340/511; 340/588; 340/589

[58] Field of Search ..... 340/506, 587, 340/511, 588, 589

[56] References Cited

U.S. PATENT DOCUMENTS 4,749,987 6/1988 Ishii ..... 340/511

4,884,222 11/1989 Nagashima et al. ..... 340/588

5,168,262 12/1992 Okayama ..... 340/511

5,260,687 11/1993 Yamauchi et al. ..... 340/511

*Primary Examiner*—Donnie L. Crosland

*Attorney, Agent, or Firm*—Max Fogiel

[57] ABSTRACT

In a fire alarm device for detecting the physical quantities of substances arising from the outbreak of a fire and giving a fire alarm, membership functions showing the correlation between an arising quantities calculated by the detected physical quantities and the danger degree which a man would feel with respect to the physical quantities are preset, the danger degree with respect to the arising value calculated by the physical quantities actually detected by a detection means is obtained by using the membership functions, and an alarm and control in accordance with the danger degree is given. Therefore, there is provided a fire alarm device capable of judging the outbreak of a fire based on an actual fire situation and giving an alarm and control in accordance with the degree of danger which a man would feel with respect to the scale, situation and so on of the fire.

5 Claims, 4 Drawing Sheets

FIRE ALARM DEVICE

BACKGROUND OF THE INVENTION

The present application is a continuation-in-part of the parent application Ser. No. 816,186, filed Jan. 2, 1992 abandoned.

FIELD OF THE INVENTION

The present invention relates to a fire alarm device for measuring the physical quantities of heat, smoke and so on arising from the outbreak of a fire and reporting the fire, and more particularly, to a fire alarm device for detecting the outbreak of a fire with a high degree of precision by using a membership function.

DESCRIPTION OF THE RELATED ART

In a typical fire alarm device, a smoke sensor and a heat sensor are set in every surveillance area, and absolute values or change values of the physical quantities of substances (heat, smoke and so on) arising from a fire are detected by these sensors so as to detect the outbreak of the fire. In other words, it is determined that a fire has occurred by comparing data obtained from the sensors with a preset threshold value.

However, in such a conventional fire alarm device, measured values detected by the heat sensor and the smoke sensor show the quantities of heat and smoke accumulated in the surveillance area. Therefore, these values are different in accordance with environment condition, such as, a sensor setting place and the size of room in which the sensors are set, even if the scale of fire is same.

Thus, the detection result of the conventional fire alarm device does not clearly indicate whether measured values are obtained from a large-scale fire, or whether the quantity of accumulated heat is large though the scale of the fire is not so large. Therefore, the scale and situation of a fire origin as criteria for judging the outbreak of the fire are not fixed, and thus it is impossible to give an alarm based on an actual fire situation.

While, the applicant provides a fire alarm device as PCT/JP90/00062 (designated states: AT,AU,DE,FI,GB,US), which calculates the scale of a fire origin and carries out a fire determination by it.

This invention discloses a fire alarm provided with a sensor set in a fire monitoring section and adapted to detect the variations of physical phenomena accompanying a fire, such as the variations of temperature, densities of smoke and CO gas, a means for calculating primary fire source information including the quantities of generated heat, smoke and gases on the basis of the information detected by the sensor, and a fire judgment means for judging the occurrence of a fire on the basis of the quantity of variations of the fire source information, which are determined by the fire source information calculating means, and the correction between the information, and giving an alarm. In this invention, arising quantities, such as quantity of generated heat etc., are calculated by the means for calculating primary fire source information, that is, the calculation of arising quantities itself is well known as the prior art.

Furthermore, if a man actually encounters a fire, he empirically judges the degree of danger of the fire and takes action depending upon the degree of danger. Accordingly, the contents of an alarm should be related to the degree of danger in consideration of the means for escape.

SUMMARY OF THE INVENTION

An object of the present invention is to provide a fire alarm device capable of judging a fire based on an actual fire situation and giving an alarm depending upon the degree of danger which a man would feel with respect to the scale, situation and so on of the fire.

In order to achieve the above object, a fire alarm device of the present invention comprises a detection means 1 for detecting the physical quantities increasing with the outbreak of a fire, such as changes in temperature, smoke density, generated gas density and atmospheric pressure, and a danger degree calculating means 3 for presetting membership functions expressing the correlation between the arising quantities per unit time, such as heat release quantity, smoke generation quantity and gas generation quantity calculated by the physical quantities and the degree of danger which a man would feel with regard to such quantity, and calculating the degree of danger with regard to the arising quantities by using the membership functions so as to give an alarm and control in accordance with the degree of danger.

According to a fire alarm device having such construction, since the outbreak of a fire is judged and the danger of degree is obtained by using the membership functions, a result equivalent to the judgment of the man can be obtained. Therefore, it is possible to give a high-precision and proper fire alarm.

Furthermore, the fire alarm device is effective in reducing false alarms.

DESCRIPTION OF THE PREFERRED EMBODIMENT

Figure 1:
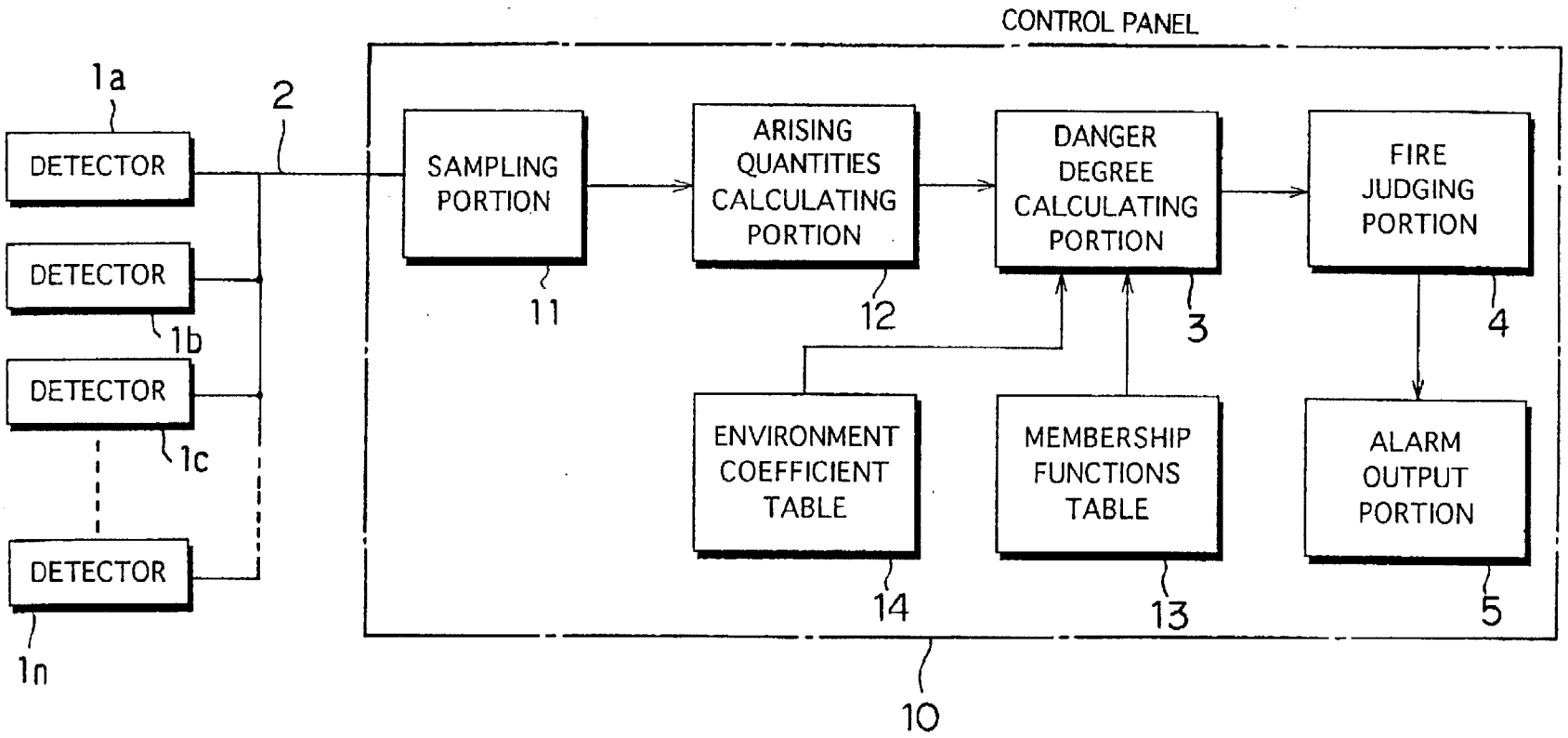
FIG. 1 is a structural view in block form of a fire alarm device according to an embodiment of the present invention.

A preferred embodiment of the present invention will now be described with reference to the drawings.

the construction of a fire alarm device of the embodiment will be first explained with reference to FIG. 1. Detectors 1*a* to 1*n* like heat sensors and smoke sensors detect as analog values the physical quantities of substances, such as heat temperature, smoke density and gas density, increasing with the outbreak of a fire. One detector or a plurality of detectors are placed in every surveillance area.

Output signals of the detector 1*a* to 1*n* are time-sequentially supplied to a control panel 10 through a transmission line 2 by sequentially scanning the detectors 1*a* to 1*n* in a predetermined cycle.

The control panel 10 comprises a sampling portion 11, an arising quantities calculating portion 12, a danger degree calculating portion 3, a fire judging portion 4, an alarm output portion 5, a membership functions table 13, and an environment coefficient table 14. Note, when these functions are carried out by a computer, the functions of the sampling portion 11, the arising quantities calculating portion 12, the danger degree calculating portion 3, the fire judging portion and the alarm output portion 5 are carried out by CPU, and the functions of membership functions table 13 and environment coefficient table 14 are carried out by memory such as EEPRM and the like.

Here, the sampling portion 11 sequentially scans the detectors and collects an analog data. The arising quantities calculating portion 12 calculates heat release quantity, smoke generation quantity, gas generation quantity and the like per predetermined time by analog data transferred from the detectors. The danger degree calculating portion 3 calculates data on the danger degree based on arising quantities calculated by the analog data transferred from the detectors 1*a* to 1*n* according to the membership functions table 13 and the environment coefficient table 14, and outputs the data to a fire judging portion 4.

The membership functions table 13 stores membership functions showing the correlation between the arising quantities per unit time, such as heat release quantity, smoke generation quantity and gas generation quantity calculated by the physical quantities increasing with the outbreak of a fire and the danger degree which a man would feel with regard to the arising value, or data corresponding to the membership functions, in the shape of a lookup table. The membership functions are obtained by making many subjects experience combustion states on the assumption of various kinds of fires, and converting heat release quantity, smoke generation quantity and gas generation quantity, when a person feels danger with regard to the combustion states, into numerical values or functions by statistical processing.

On the other hand, the environment coefficient table 14 stores the coefficient showing the environmental condition, such as the size of room and whether or not there are easy burning materials around fire. For example, even if the same scale fire, a man in a narrow room feels more dangerous than one in a broad room. Further, a man feels more dangerous the case which there are easy burning materials, such as a quilt and clothes, around fire than the case which fire is surrounded by concrete walls. The environment coefficient shows the relation, and it is multiplied at the time of calculating the danger degree by the membership functions in the danger degree calculating portion 3. For example, in case that fire occurs in dangerous environment, the environment coefficient is set to make the danger degree data higher on the danger degree calculation in the danger degree calculating portion 3.

The danger judging portion 4 compares a plurality of preset threshold values with the data on the danger degree supplied from the danger degree calculating portion 3, and judges the outbreak of a fire based on the relation between the threshold values and the data. If it is judged that the fire has occurred, the danger judging portion 4 determines the kind of an alarm, and transfers a signal of the alarm to various kinds of alarm devices and fire prevention devices through an alarm output portion 5.

Figure 2:
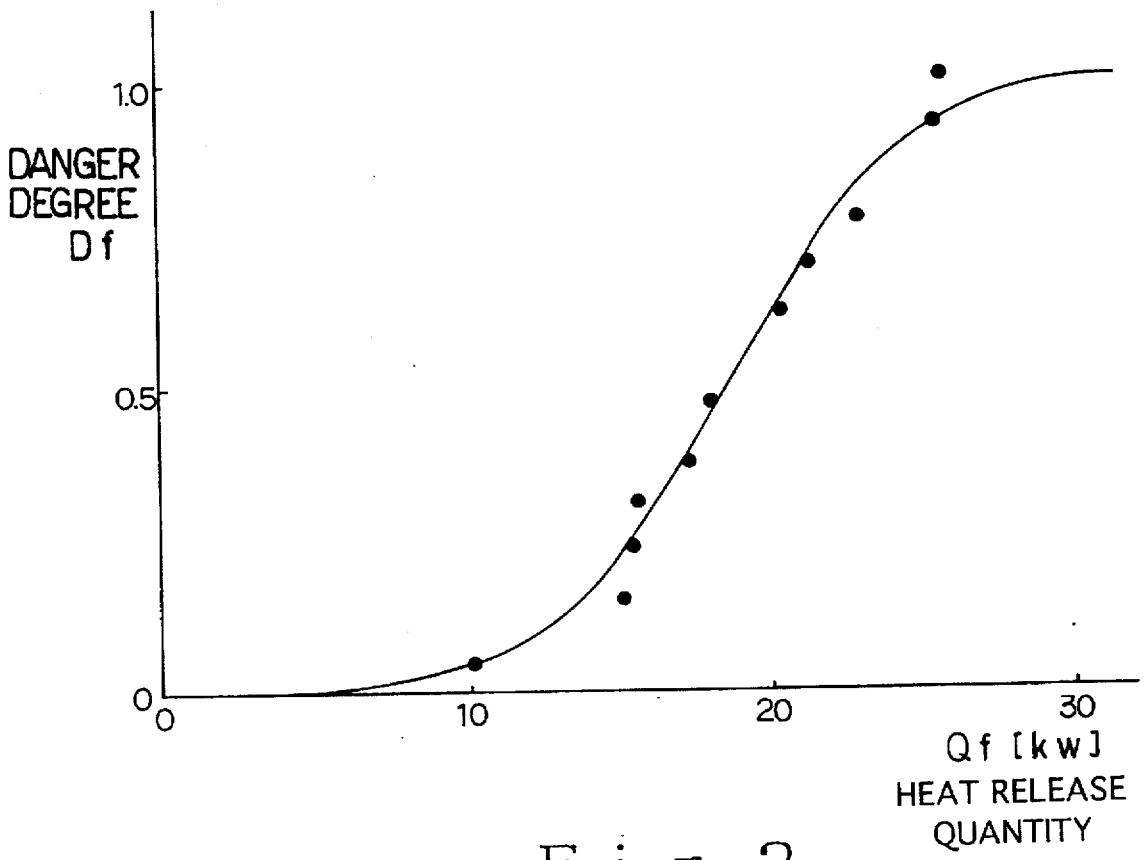
FIG. 2 is an explanatory graphical view showing an example of a membership function concerning the heat release quantity to be set in a danger degree calculating portion of the embodiment.

FIG. 2 illustrates a membership function expressing the degree of danger which a subject would feel with respect to the heat release quantity of an inflammable article when a fire occurs. In other words, the horizontal axis indicates the heat release quantity Qf [kW] of an inflammable article which corresponds to the scale of the fire, and the vertical axis indicates the degree to which the subject would feel danger with regard to the heat release quantity (danger degree Df). Assuming that the danger degree of a state where all subjects feel danger is 1.0, the membership function of the danger degree is formed by statistically processing the ratio of the subjects who feel danger when the heat release quantity Qf is less than that of the above state.

Membership functions which are thus obtained empirically or data corresponding to the functions are preset in the membership functions table 13. The arising quantities calculating portion 12 calculates a heat release quantity Qf based on an analog data transferred from the heat sensor of the detectors 1*a* to 1*n*, calculates a danger degree Df based on the membership functions table 13, from the heat release Qf calculated in the arising value calculating portion 12, and outputs the danger degree Df to the fire judging portion 4.

Figure 3:
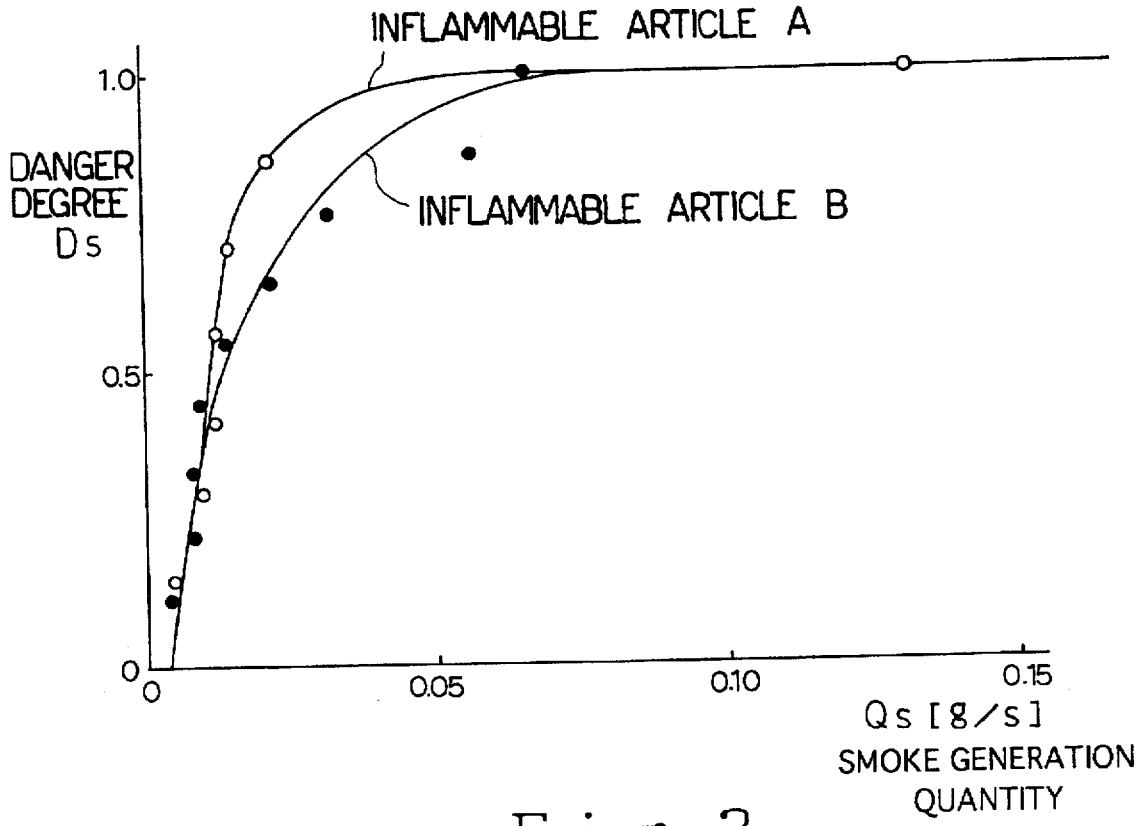
FIG. 3 is an explanatory graphical view showing an example of a membership function concerning the smoke generation quantity to be set in the danger degree calculating portion of the embodiment.

On the other hand, FIG. 3 shows a membership function concerning the smoke generation quantity obtained in the same manner as FIG. 2. The danger degree is determined based on the quantity of smoke by presetting the membership functions table 13 concerning the smoke generation quantity Qs shown in FIG. 3 in the control panel 10. In other words, the membership function shown in FIG. 3 is obtained by converting the ratio Ds of a plurality of subjects who would feel danger with regard to the smoke generation quantity Qs [g/s] when, for example, a "kotatsu" (inflammable article A) and a "tatami" (inflammable article B) are burnt, into numerical values.

The arising quantities calculating portion 12 calculates a smoke generation quantity Qs based on an analog data corresponding to the smoke density transferred from the smoke sensor of the detectors 1*a* to 1*n* in the same manner as in the case of the heat release quantity. And the danger degree calculating portion 3 calculates and outputs a danger degree Ds corresponding to the smoke generation quantity Qs.

Figure 4:
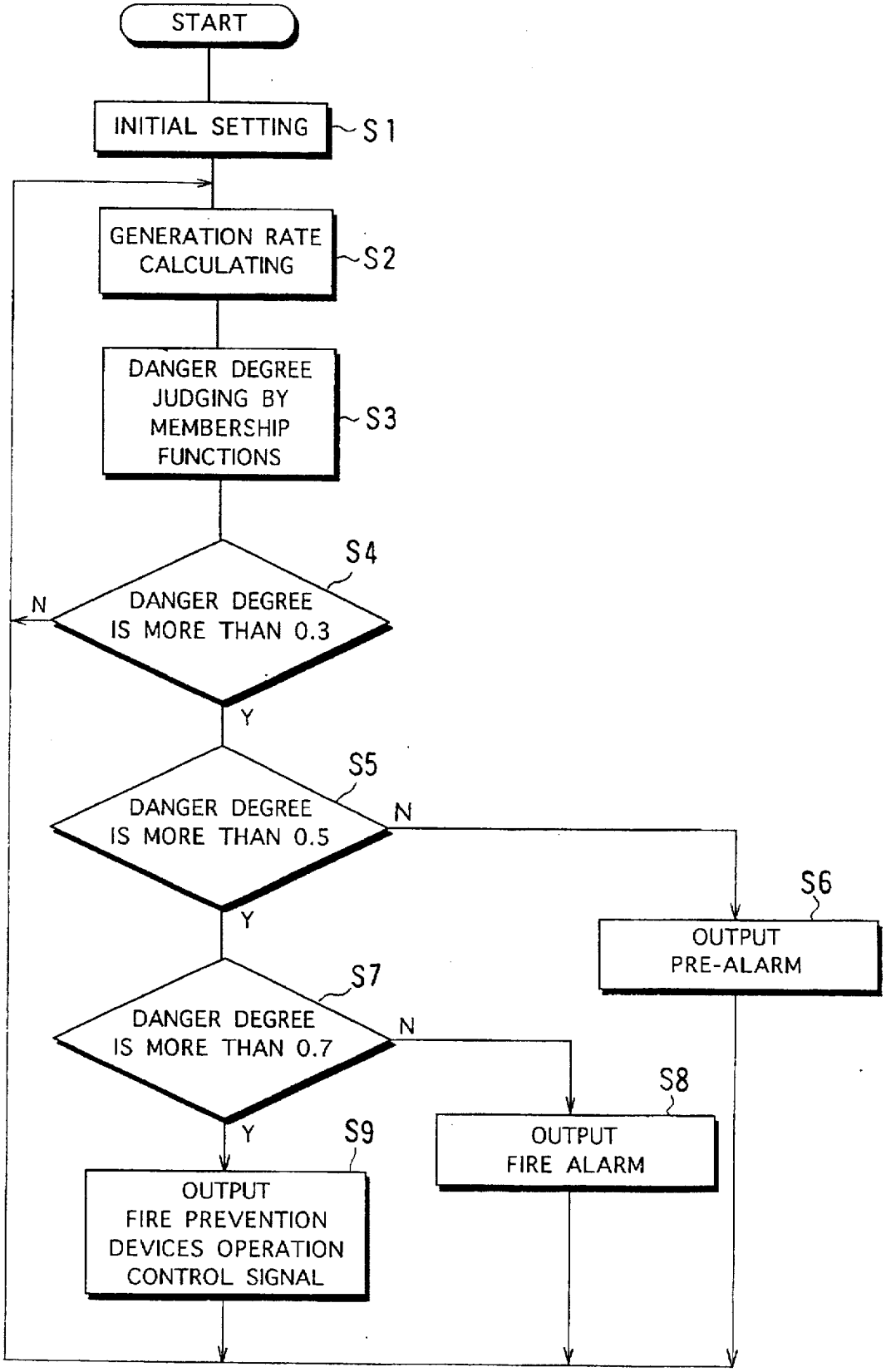
FIG. 4 is a flowchart showing an order of fire judgment of the embodiment.

When the data representing the danger degree output from the danger degree calculating portion 3 is supplied to the fire judging portion 4, it is compared with threshold values preset in the fire judging portion 4. Alarm data in accordance with the comparison result is output from a plurality of preset data. Here, the order of a fire judgment according to the embodiment by a computer will be described below. FIG. 4 is a flowchart showing the order.

In this embodiment, after initial setting (step 1, hereinafter S1), the arising quantities calculating portion 12 calculates the heat release quantity Qf and the smoke generation quantity Qs by the analog data from each detector. The danger degree corresponding to the heat release quantity Qf and the smoke generation quantity Qs, calculated in the arising quantities calculating portion 12, is calculated by the danger degree calculating portion 3 based on the membership functions, shown as FIGS. 2 and 3, stored in the membership functions table 13 (S3). Next, fire judging portion 4 judges the danger degree. The fire judging portion 4 judge whether the danger degree Df and Ds are not less than 0.3 or not (S4). Further, the fire judging portion 4 judges whether the danger degree Df and Ds are not less than 0.5 or not (S5), if they are not less than 0.3 and less than 0.5, it is judged that an incipient fire has occurred, a pre-alarm is sounded in a guardroom (S6). On the other hand, if the danger degree Df and Ds are not less than 0.5, then the fire judging portion 4 judges whether they are not less than 0.7 or not (S7). If the danger degree Df and Ds are not less than 0.5 and less than 0.7, it is judged that the fire has been enlarged, all alarm devices in the building are made to give alarms and to broadcast a message for escape. Furthermore, if the danger degree Df and Ds are not less than 0.7, it is judged that the fire is dangerous condition, a control output to operate fire preventing equipment, such as a fire door, is outputted (S9).

Note, in the above mentioned example, the fire judgement by the danger degree calculated by the heat release quantity is separately carried out from the fire judgement by the danger degree calculated by the smoke generation quantity (OR judgement). Accordingly, if the judgement "pre-alarm" is given by one of the judgements, a pre-alarm is given to a guardroom even if the judgement "pre-alarm" is not given by the other judgement.

On the other hand, it is possible to calculate the danger degree by multiplying the aforementioned environment coefficient corresponding to the size of room and the surrounding condition (whether easy burning materials are existing or not). The calculation is carried out by the danger degree calculating portion 3 based on the environment coefficient table 14. And it is also possible to change the danger level in the fire judging portion 4 to give pre and main alarms by using the aforementioned environment coefficient.

According to the embodiment described above, since the outbreak of a fire is detected and the danger degree is obtained by using the membership functions, it is possible to introduce the logic of decision by majority to the fire judgement. Namely, in the conventional fire judgement system, the threshold valve is only set to data sent from detectors, and the fire judgement is carried out uniformly by using the threshold value. To the contrary, according to the present invention, the judgement result equivalent to the judgement of the man with regard to the fire can be obtained, and a high-precision and proper fire alarm can be output.

The above judgement process of the fire judging portion 4 is given as an example. Therefore, it is possible to process the danger degree Df obtained based on the membership function concerning the heat release quantity and the danger degree Ds obtained based on the membership function concerning the smoke generation quantity under a compound condition.

As an example of compound judgement, there is a method that the obtained judgement is outputted only when the same results are obtained by both of the judgements. For example, only when a main fire alarm output is obtained with regard to the heat release quantity and the smoke generation quantity, a main fire alarm is outputted. Thereby, it is possible to avoid a false alarm. However, there is a possibility that the term for outputting an alarm is longer by the method. Therefore, when the main fire alarm output is obtained by one of the judgements, it is possible to lower the judgement level of the other judgement to shorten the term for outputting the alarm. Further, it is possible to output the main fire alarm when pre-alarm outputs are obtained by both of the judgements. It is possible to avoid a false alarm and to shorten the term for outputting the alarm by the compound judgement.

Although the membership functions concerning the heat release quantity and the smoke generation quantity of the physical quantities are formed and the danger degree is output according to the membership functions in the above embodiment, other physical quantities, for example, a change in atmospheric pressure or the like may be used.

What is claimed is:

1. A fire alarm device for judging an outbreak of a fire and emitting an alarm, comprising:

detection means for detecting at least one physical quantity of physical quantities in form of temperature, smoke density and gas arising from the outbreak of the fire;

arising quantity calculating means for calculating heat release quantity smoke generation quantity, gas generation quantity and the like per unit time based on detection data transferred from said detection means;

membership functions table means for storing coefficients providing predetermined correlation between arising value per unit time, such as heat release quantity, smoke generation quantity and gas generation quantity and the danger degree which a person would feel with respect to said arising value;

danger degree calculating means for calculating the danger degree corresponding to the heat release quantity, the smoke generation quantity, gas generation quantity and the like calculated by said arising quantity calculating means based on said membership functions table means; and judging means for determining the kind of an alarm to be emitted depending upon said danger degree calculated by said danger degree calculating means; environment coefficient table means for storing coefficients providing environmental conditions such as size of a room and whether or not easy-burning materials are present, said danger degree calculating means calculating the danger degree based on said membership functions table means and the environment coefficient table means; said detection means comprising a plurality of different detectors; sampling means between said detectors and said arising quantity calculating means for scanning sequentially values from said different detectors and transmitting said values to said arising quantity calculating means; said judging means including output pre-alarm means, output fire alarm means and output fire prevention devices control signal actuated in dependence on the danger degree calculated by said danger degree calculating means.

2. A fire alarm device for judging an outbreak of a fire and emitting an alarm, comprising:

detection means for detecting at least one physical quantity of physical quantities in form of temperature, smoke density and gas arising from the outbreak of the fire;

arising quantity calculating means for calculating heat release quantity smoke generation quantity, gas generation quantity and the like per unit time based on detection data transferred from said detection means;

membership functions table means for storing coefficients providing predetermined correlation between arising value per unit time, such as heat release quantity, smoke generation quantity and gas generation quantity and the danger degree which a person would feel with respect to said arising value;

danger degree calculating means for calculating the danger degree corresponding to the heat release quantity, the smoke generation quantity, gas generation quantity and the like calculated by said arising quantity calculating means based on said membership functions table means; and judging means for determining the kind of an alarm to be emitted depending upon said danger degree calculated by said danger degree calculating means.

3. A fire alarm device for judging the outbreak of a fire and emitting an alarm as defined in claim 2, including environment coefficient table means for storing coefficients providing environmental conditions such as size of a room and whether or not easy-burning materials are present, said danger degree calculating means calculating the danger degree based on said membership functions table means and the environment coefficient table means.

4. A fire alarm device for judging an outbreak of a fire as defined in claim 2, wherein said detection means comprises a plurality of different detectors; sampling means between said detectors and said arising quantity calculating means for scanning sequentially values from said different detectors and transmitting said values to said arising quantity calculating means.

5. A fire alarm device for judging an outbreak of a fire as defined in claim 2, wherein said judging means includes output pre-alarm means, output fire alarm means and output fire prevention devices control signal actuated in dependence on the danger degree calculated by said danger degree calculating means.

* * * * *